United States Patent [19]

Saitoh

[11] Patent Number: 4,578,044

[45] Date of Patent: Mar. 25, 1986

[54] MAGNETICALLY MOVABLE MODEL TOY

[75] Inventor: Shigeru Saitoh, Tokyo, Japan

[73] Assignee: Masudaya Corporation Limited, Tokyo, Japan

[21] Appl. No.: 635,897

[22] Filed: Jul. 30, 1984

[30] Foreign Application Priority Data

Jan. 30, 1984 [JP] Japan ..... 59-13515

[51] Int. Cl.[4] ..... A63H 33/26; A63H 3/52; A63H 13/00

[52] U.S. Cl. ..... 446/134; 446/156; 446/267; 446/351

[58] Field of Search ..... 446/131, 133, 129, 132, 446/134, 135, 137, 138, 139, 156, 267, 330, 351, 361, 359; 361/203

[56] References Cited

U.S. PATENT DOCUMENTS

| | | | |
|---|---|---|---|
| 2,774,185 | 12/1956 | Kosch | 446/129 |
| 3,239,956 | 3/1966 | Canonica, Jr. | 446/134 |
| 3,425,157 | 2/1969 | Hartsock | 446/134 |
| 3,596,146 | 7/1971 | McDonald | 361/203 |
| 3,783,550 | 1/1974 | Andrews | 446/484 |
| 4,047,323 | 9/1977 | Biffi | 446/131 |
| 4,282,681 | 8/1981 | McCaslin | 446/484 |

FOREIGN PATENT DOCUMENTS

| | | | |
|---|---|---|---|
| 242927 | 11/1925 | United Kingdom | 446/267 |
| 1045898 | 10/1983 | U.S.S.R. | 446/267 |

*Primary Examiner*—Robert A. Hafer
*Assistant Examiner*—Daniel Nolan
*Attorney, Agent, or Firm*—Michael J. Striker

[57] ABSTRACT

A toy including a movable model, components for generating and alternating a magnetic field in response to a direct current, a permanent magnet disposed in the generated magnetic field, and a component for transmitting movement of the permanent magnet in the generated magnetic field to the movable model.

19 Claims, 3 Drawing Figures

MAGNETICALLY MOVABLE MODEL TOY

BACKGROUND OF THE INVENTION

The present invention relates to a Magnetically Movable Model Toy. More particularly, it relates to a magnetically movable model toy utilizing the magnetic attraction of two magnets.

Magnetically movable model toys of the above mentioned general type are known in the art. Permanent magnets have been used in movable toys, however, the movement has been caused by the attraction of one permanent magnet to another.

SUMMARY OF THE INVENTION

Accordingly, it is an object of the present invention to provide a magnetically movable model toy which avoids the disadvantages of the prior art.

More particularly, it is an object of the present invention to provide a magnetically movable model toy which utilizes only one permanent magnet.

In keeping with these objects, and with others which will become apparent hereinafter, one feature of the present invention resides, briefly stated, in a magnetically movable model toy having a movable model, means for generating and alternating a magnetic field in response to a direct current, wherein a permanent magnet is disposed in the generated magnetic field and means are provided for transmitting the movement of the permanent magnet in the generated magnetic field to the movable model.

When the magnetically movable model toy is designed in accordance with the present invention, the permanent magnet vibrates and the vibrations are transmitted to the movable model via the transmitting means.

Still another feature of the present invention is that the means for transmitting movement of the permanent magnet in the generated magnetic field to the movable model includes a string having ends respectively connected to the permanent magnet and the movable model.

A further feature of the present invention is that the permanent magnet is small.

Yet another feature of the present invention is that the movable model is a fish, having a mouth, in which is attached the end of the string.

Another feature of the present invention is that a vessel is provided for containment of the fish.

Still another feature of the present invention is that the vessel is hemispherically shaped and has a depressed base portion.

Still yet another feature of the present invention is that the permanent magnet is disposed in the depressed base portion of the vessel.

Yet another feature of the present invention is that the vessel contains a liquid.

Another feature of the present invention is that the liquid the vessel contains, is water.

Still yet another feature of the present invention is that there is provided a coil, a former, and a housing having a center, the coil is formed around the former and disposed in the center of the housing below the depressed base portion of the vessel which is mounted on the housing.

Yet another feature of the present invention is that the former contains an iron core.

Still another feature of the present invention is that there is provided an open mouthed casing of magnetic material in which the central core is disposed.

Another feature of the present invention is that the open mouthed casing of magnetic material is cylindrically shaped and the central core is composed of iron.

Still another feature of the present invention is that the open mouthed casing of magnetic material has a base which extends to form a magnetic path from the central core below the former.

Yet still another feature of the present invention is that the central iron core as an upper end that is an axial pole and the cylindrically shapped open mouthed casing of magnetic material has a curved wall that is a peripheral pole.

Still yet another feature of the present invention is that the means for generating and alternating a magnetic field in response to a direct current is disposed in the housing.

Another feature of the present invention is that the means for generating and alternating a magnetic field in response to a direct current includes first and second pairs of NAND gates, first and second pairs of resistances, and first, second, third and fourth transistors, the first pair of NAND gates constitutes a multivibrator circuit having an output regulated by the second pair of NAND gates which supplies the output of the multivibrator circuit through the first and second pairs of resistances to the bases of the first, second, third and fourth transistors which are arranged in a balanced bridge circuit.

Yet still another feature of the present invention is that the means for generating and alternating a magnetic field in response to a direct current further includes a coil having ends that are respectively connected to the junction of the collector of the first transistor and the emitter of the second transistor and the junction of the collector of the third transistor and the emitter of the fourth transistor.

Still yet another feature of the present invention is that the means for generating and alternating a magnetic field in response to a direct current further includes a switch which connects the direct current across the common collector junction of the second and fourth transistors and the common emitter junction of the first and third transistors.

Another feature of the present invention is that one of the NAND gates of the second pair of NAND gates has an output that is high and causes the first and fourth transistors to be switched on through the first pair of resistances so that one of the coil ends becomes negative and the other end becomes positive.

Finally, still a further feature of the present invention is that the other one of the NAND gates of the second pair of NAND gates has an output that is high and causes the second and third transistors to be switched on through the second pair of resistances so that one of the coil ends becomes positive and the other end becomes negative.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
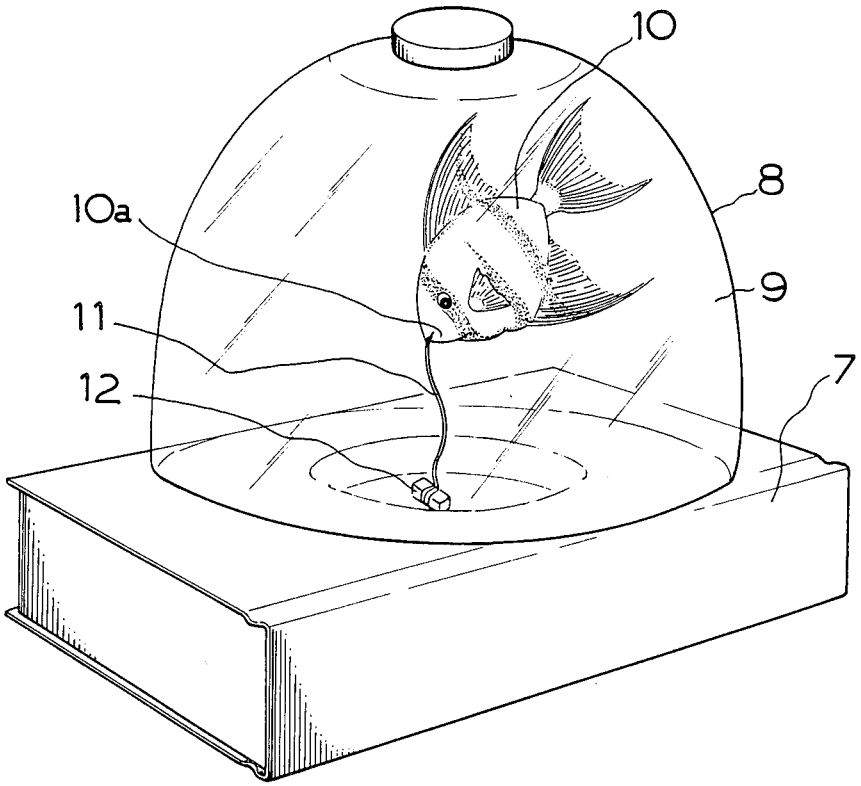
FIG. 1 is a perspective view of the toy of the present invention.

Referring to FIG. 1 which shows a model fish 10 floating in water 9 contained in a hemispherical vessel 8 mounted on a housing 7. The model fish 10 has a mouth 10*a* to which is attached a fine string 11 which is connected to a small permanent magnet 12 disposed in a depressed portion of the base of the vessel 8. The model fish 10 is, in this way, connected to the small permanent magnet 12.

Figure 2:
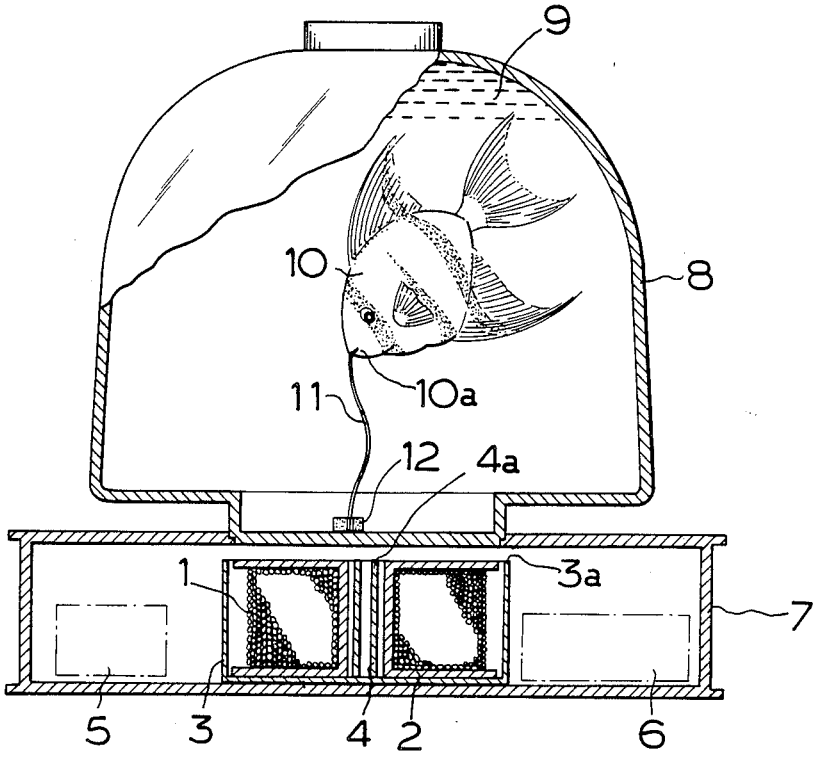
FIG. 2 is a partially sectioned view of the toy shown in FIG. 1.

As can be seen from FIG. 2, the housing 7 contains a direct current cell 5 and a circuit 6 which converts the direct current into alternating current. In the center of the housing 7, below the depressed portion of the vessel 8, is disposed a coil 1 wound around a former 2 which contains a central core 4 and lies within an open-mouthed cylinder of magnetic material 3. The open-mouthed cylinder of magnetic material 3 has a base which extends to form a magnetic path from the central core 4 below the former 2. The curved wall of the open-mouthed cylinder 3 forms a peripheral pole 3*a* of the electromagnetic assembly while the upper end of the central core 4 forms an axial pole 4*a*.

Figure 3:
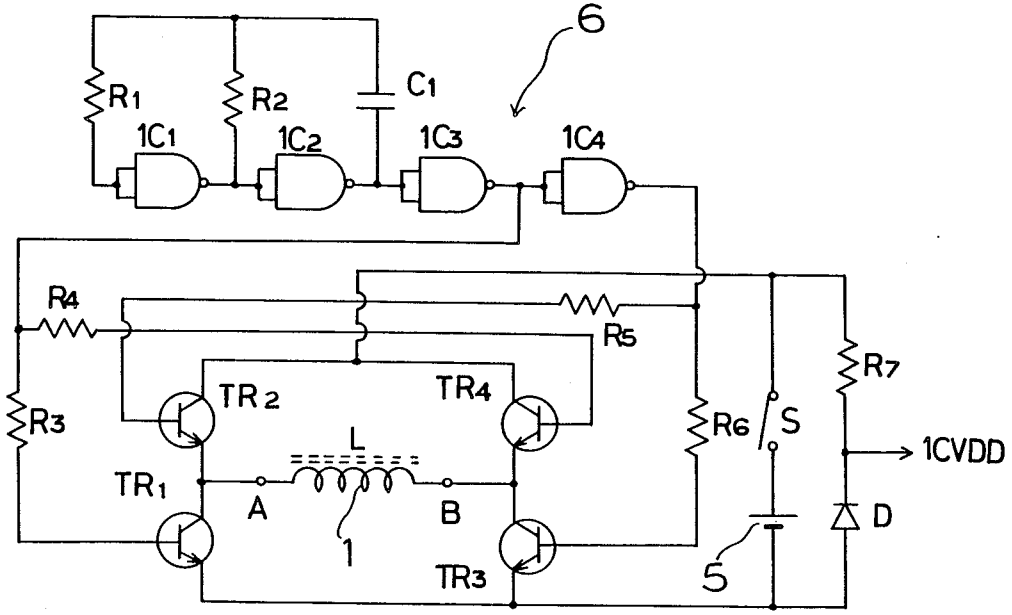
FIG. 3 is a circuit diagram of the toy shown in FIG. 1.

Direct current from the cell 5 is converted into alternating current by the circuit 6, shown in FIG. 3. The alternating current is supplied to a coil 1. NAND gates $1C_1$ and $1C_2$ constitute a multivibrator circuit and NAND gates $1C_3$ and $1C_4$ regulate the output of the multivibrator circuit and supply the output of the multivibrator circuit through input resistances to the bases of transistors $TR_1$–$TR_4$ arranged in a balanced bridge circuit. The coil 1 is connected across terminals A and B which are connected respectively to the junctions of the collector of the transistor $TR_1$ and the emitter of the transistor $TR_2$ and the junction of the collector of the transistor $TR_3$ and the emitter of the transistor $TR_4$. The direct current cell 5 is connected through a switch 5 across the common collector junction of the transistors $TR_2$ and $TR_4$ and the common emitter junction of the transistors $TR_1$ and $TR_3$.

Circuit 6 operates as follows. When the output of NAND gate $1C_3$ is high, the transistors $TR_1$ and $TR_4$ are switched on through input resistances $R_3$ and $R_4$ so that the terminal A becomes negative and the terminal B becomes positive. Alternatively, when the output of NAND gate $1C_4$ is high, the transistors $TR_2$ and $TR_3$ are switched on through input resistances $R_5$ and $R_6$ so that the terminal A becomes positive and the terminal B negative. The change of polarity of the lines of magnetic force generated by the coil 1 changes the forces on the small permanent magnet 12 and causes it to vibrate. This vibration is transmitted through the fine string 11 to the model fish 10 floating in the water 9.

When iron is used for the open-mouthed magnetic cylinder 3 and for the central core 4, there is created a strong magnetic field. Therefore, there is provided a separation between the poles 3*a* and 4*a* and thus preventing the permanent magnet 12 from becoming attracted to either of the poles which would restrict or prevent its movement.

Due to the changes in the magnetic force, in accordance with the frequency of the alternating current, the model fish 10 connected to the permanent magnet 12 through the string 11 moves irregularly while floating in the water 9. This irregular movement simulates a live fish searching for bait and swimming about. When the permanent magnet 12 turns, the fine string 11 twists and thus shortens its length. This shortening, draws the model fish 10 down to the bottom of the vessel 8. When the resistance to the twisting of the fine string 11 overcomes the turning action of the permanent magnet 12, the fine string 11 unwinds and elongates. This elongation causes the model fish 10 to ascend abruptly in the water 9 as if to pick up bait. This very interesting and attractive movement resembles the movement of a live fish.

The use of a direct current cell rather than main current makes the toy fish safe and suitable as an ornament.

Diode D and resistor 7 are connected in parallel across the cell 5 and the switch S. Their junction provides a constant current power supply ICVDD for the integrated circuit NAND gates in the circuit 6.

It will be understood that each of the elements described above, or two or more together, may also find a useful application in other types of magnetically movable model toys differing from the types described above.

While the invention has been illustrated and described as embodied in a magnetically movable model toy, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A toy, comprising:

a vessel having a base portion;

a fluid contained within said vessel;

a buoyant moveable model buoyantly supported by said fluid;

means for generating and alternating a magnetic field in response to a direct current;

a permanent magnet located on said base portion, disposed in said generated magnetic field and moveable in response to the latter; and means for transmitting the movement of said permanent magnet in said generated magnetic field to said moveable model, said transmitting means including a string having ends respectively attached to said permanent magnet and said moveable model so that movement of said permanent magnet in said generated magnetic field causes said string to move thereby transmitting said movement to said moveable model.

2. The toy as defined in claim 1, wherein said permanent magnet is relatively small.

3. The toy as defined in claim 1, wherein said movable model is a fish having a mouth in which is attached an end of said string.

4. The toy as defined in claim 1, wherein said vessel is hemispherically shaped and said base portion has a depression.

5. The toy as defined in claim 4, wherein said permanent magnet is disposed in said depression of said base portion of said vessel.

6. The toy as defined in claim 1, wherein said fluid is a liquid.

7. The toy as defined in claim 6, wherein said liquid is water.

8. The toy as defined in claim 4, wherein said magnetic field generating and alternating means includes a coil, a former, and a housing having a center, said coil being formed around said former and disposed in said center of said housing below said depressed base portion of said vessel which is mounted on said housing.

9. The toy as defined in claim 8, wherein said former contains a central core.

10. The toy as defined in claim 9; further comprising an open mouthed casing of magnetic material in which said central core is disposed.

11. The toy as defined in claim 10, wherein said open mouthed casing of magnetic material is cylindrically shaped and said central core is composed of iron.

12. The toy as defined in claim 10, wherein said open mouthed casing of magnetic material has a base extending to form a magnetic path from said central core below said former.

13. The toy as defined in claim 11, wherein said central iron core has an upper end that is an axial pole and said cylindrically shaped open mouthed casing of magnetic material has a curved wall that is a peripheral pole.

14. The toy as defined in claim 8, wherein said means for generating and alternating a magnetic field in response to a direct current is disposed in said housing.

15. The toy as defined in claim 1, wherein said means for generating and alternating a magnetic field in response to a direct current includes first and second pairs of NAND gates, first and second pairs of resistances and first, second, third, and fourth transistors, said first pair of NAND gates constituting a multivibrator circuit having an output regulated by said second pair of NAND gates supplying said output of said multivibrator circuit through said first and second pairs of resistances to the bases of said first, second, third, and fourth transistors arranged in a balanced bridge circuit.

16. The toy as defined in claim 15, wherein said means for generating and alternating a magnetic field in response to a direct current further includes a coil having ends respectively connected to the junction of the collector of said first transistor and the emitter of said second transistor and the junction of the collector of said third transistor and the emitter of said fourth transistor.

17. The toy as defined in claim 15, wherein said means for generating and alternating a magnetic field in response to a direct current further includes a switch connecting the direct current across the common collector junction of said second and fourth transistors and the common emitter junction of said first and third transistors.

18. The toy as defined in claim 16, wherein a one of said second pair of NAND gates has an output that is high causing said first and fourth transistors to be switched on through said first pair of resistances so that a one end of said coil becomes negative and the other end becomes positive.

19. The toy as defined in claim 16, wherein the other one of said second pair of NAND gates has an output that is high causing said second and third transistors to be switched on through said second pair of resistances so that said one end of said coil becomes positive and said other end becomes negative.

* * * * *